US006311460B1

(12) United States Patent
Bagwell et al.

(10) Patent No.: US 6,311,460 B1
(45) Date of Patent: Nov. 6, 2001

(54) METHOD OF USING A PACKING INSERT AS AN ASSEMBLY FIXTURE

(75) Inventors: Joan P. Bagwell, Thornton; Kimberly K. Kroeger, Boulder; Roger Alan Merriman, Lakewood, all of CO (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/533,555

(22) Filed: Nov. 1, 1999

Related U.S. Application Data

(62) Division of application No. 09/216,996, filed on Dec. 21, 1998, now Pat. No. 6,109,444.

(51) Int. Cl.[7] ..... B65B 35/50
(52) U.S. Cl. ..... 53/447; 53/474
(58) Field of Search ..... 53/428, 447, 474, 53/472, 155, 539, 540, 561, 237, 249; 206/588, 589, 590, 591, 593, 523, 576, 577, 320

(56) References Cited

U.S. PATENT DOCUMENTS

| | | | | |
|---|---|---|---|---|
| 5,127,526 | | 7/1992 | Vigue . | |
| 5,335,770 | | 8/1994 | Baker et al. . | |
| 5,417,034 | * | 5/1995 | Gabler et al. | 53/399 |
| 5,457,938 | * | 10/1995 | Butterfield et al. | 53/399 |
| 5,515,976 | | 5/1996 | Moren et al. . | |
| 5,706,951 | | 1/1998 | Oinuma et al. . | |
| 5,715,940 | | 2/1998 | Son . | |
| 5,806,286 | * | 9/1998 | Oinuma et al. | 53/472 |
| 5,871,097 | | 2/1999 | Shida et al. . | |
| 6,109,444 | | 8/2000 | Bagwell et al. . | |

* cited by examiner

*Primary Examiner*—Peter Vo
*Assistant Examiner*—John Paradiso
(74) *Attorney, Agent, or Firm*—Duft, Graziano & Forest,P.C.

(57) ABSTRACT

The present multi-function packing insert functions as a packing insert for the shipment of components or subassemblies from a vendor to a manufacturer, as a tray and holding fixture during processing of the components or subassemblies on the manufacturer's assembly line, and as the packing inserts for shipping the final assembled product from the manufacturer to the customer. This multi-function packing insert thereby reduces the overall cost of packing materials and reduces material handling and floor space requirements throughout the manufacturing process, since the packing materials received from the vendor(s) are used for that purpose. The coordination of packing insert design between the component and subassembly vendors and the manufacturer enables the manufacturer to reuse the received packing inserts to assemble, package and ship the final assembled product. The packing inserts used for this purpose can come from more than one vendor, can be used by the vendor(s) to package more than one component or subassembly, and can be customized beyond the needs of the vendor(s) to thereby provide additional functionality for the manufacturer.

4 Claims, 4 Drawing Sheets

METHOD OF USING A PACKING INSERT AS AN ASSEMBLY FIXTURE

CROSS-REFERENCE TO RELATED APPLICATIONS

This application is a divisional of U.S. patent application Ser. No. 09/216,996, now U.S. Pat. No. 6,109,444 filed Dec. 21, 1998 and titled "Multi-Function Packing Insert".

FIELD OF THE INVENTION

This invention relates to the field of product packaging and in particular to multi-function packing insert that functions as a packing insert for the shipment of components or subassemblies from a vendor to a manufacturer, as a tray during processing of the components or subassemblies on the manufacturer's assembly line, and as the packing insert for shipping the final assembled product from the manufacturer to the customer.

PROBLEM

It is a problem in the field of manufacturing to minimize the cost both of packing material used to ship the final assembled product to the customer as well as the cost of disposal of the packing materials that are used to pack the components and subassemblies which are received from various vendors. In particular, it is common practice in the field of product manufacture to order components or subassemblies from various vendors for incorporation into a final product. Typically, the packing materials that are used by the vendor to ship the components or subassemblies to the manufacturer are either destroyed upon receipt by the manufacturer, or shipped by the manufacturer to a recycler to be processed into other products, or occasionally returned by the manufacturer to the vendor for reuse. Each of these procedures entails a cost in terms of handling of the packing materials or waste disposal. Furthermore, none of these processes impact the need for packing materials for the manufacturer to ship the final product to the customer. In particular, disposal is the traditional method of handing received packing materials. However, this process is becoming more costly as the cost of waste disposal increases. In addition, many of the packing materials needed to ship electronic components or subassemblies used in electronic manufacturing must be electrostatic discharge free and are more costly to use than the simple impact protection packing materials. The present most common alternative to disposal is recycling the received packing materials to minimize the use of landfill space. However, the recycling program does little to impact the cost of creating packing materials for use by the manufacturer in shipping the final product to the customer. Finally, the last above-mentioned alternative is for the manufacturer to return the packing materials to the vendor for reuse. This process is resource efficient but entails the investment of a significant amount of labor to ship, unpack, store, return, restock, then reuse the packaging materials. The packaging materials that are used for this purpose are also more expensive since they are multi-use components and must be manufactured of materials that can withstand the additional handling.

Thus, there is presently no process for handling packing materials that are received by a manufacturer that is cost effective or that impacts the need for packing materials for the manufacturer to ship the final product to the customer. All existing processes for handling received packing materials have minimal impact on the overall cost of packing materials in a manufacturing environment.

SOLUTION

The above described problems are solved and a technical advance achieved by the present multi-function packing insert that functions as a packing insert for the shipment of components or subassemblies from a vendor to a manufacturer, as a tray during processing of the components or subassemblies on the manufacturer's assembly line, and as the packing insert for shipping the final assembled product from the manufacturer to the customer. This multi-function packing insert thereby reduces the cost of packing materials to ship the completed product to the customer, since the packing materials received from the vendor(s) are used for that purpose and the need for other protective coverings of the components or subassemblies are eliminated. The coordination of the packing insert design between the component and subassembly vendors and the manufacturer enables the manufacturer to use the received packing inserts in its manufacturing process and to package and ship the final assembled product. The packing inserts used for this purpose can come from more than one vendor, can be used by the vendor(s) to package more than one component or subassembly, and can be customized beyond the needs of the vendor(s) to thereby provide additional functionality for the manufacturer.

In the present multi-function packing insert, recycled paper is used to create the packing inserts to thereby make these packing inserts 100% recyclable and 100% biodegradable. As illustrated herein, a first packing insert is used to house the upper half of the product housing and a second packing insert is used to house the lower half of the product housing. Once the two packing inserts are located in-house at the manufacturer, the two packing inserts are used as holding fixtures and trays to convey the product through the assembly process ready for boxing at final product shipping. This multi-function packing insert enables the manufacturer to reuse the packing inserts that are received from the component and subassembly vendor(s) thereby providing a significant cost savings to the manufacturer.

DETAILED DESCRIPTION

In the present multi-function packing insert, recycled paper is used to create the static free packing inserts to thereby make these packing inserts 100% recyclable and 100% biodegradable. The multi-function packing insert replaces both an Expanded Polystyrene (EPS) insert that was previously used by the manufacturer to ship the assembled product to the customer, as well as the various packaging, abrasion protection and static protection packing elements that were formerly used to safeguard the subassemblies that are shipped to the manufacturer by the supplier(s).

Figure 1:
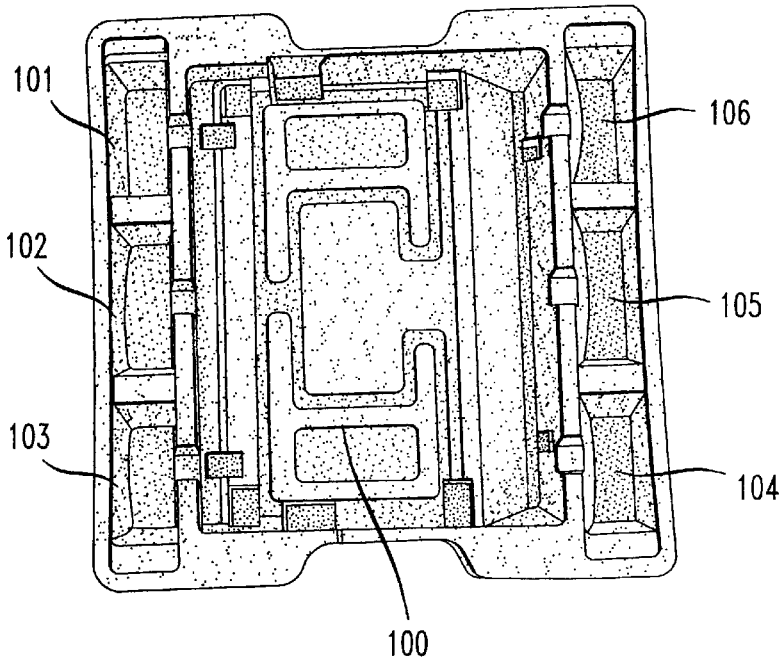
FIGS. 1 and 2 illustrate, respectively, top and bottom views of a typical upper tray that is used in the present multi-function packing insert.
Figure 2:
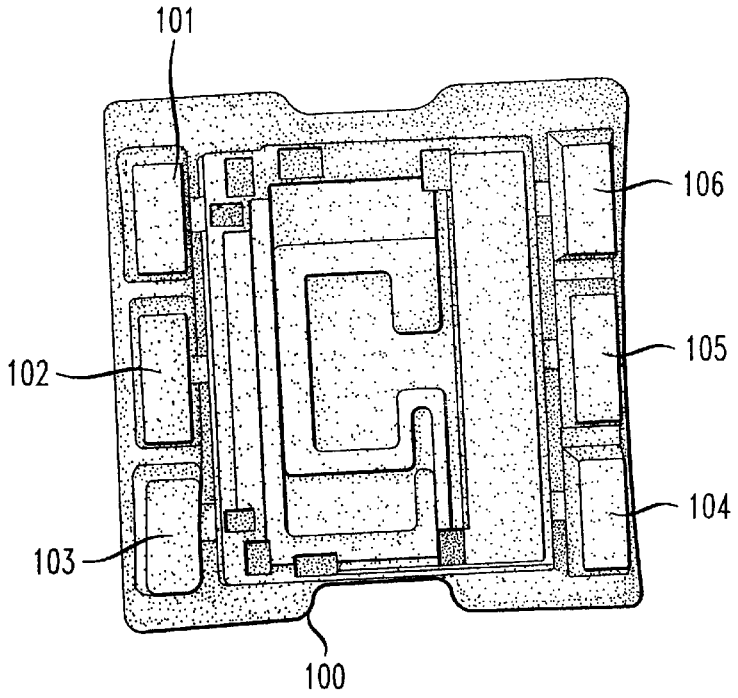
Figure 3:
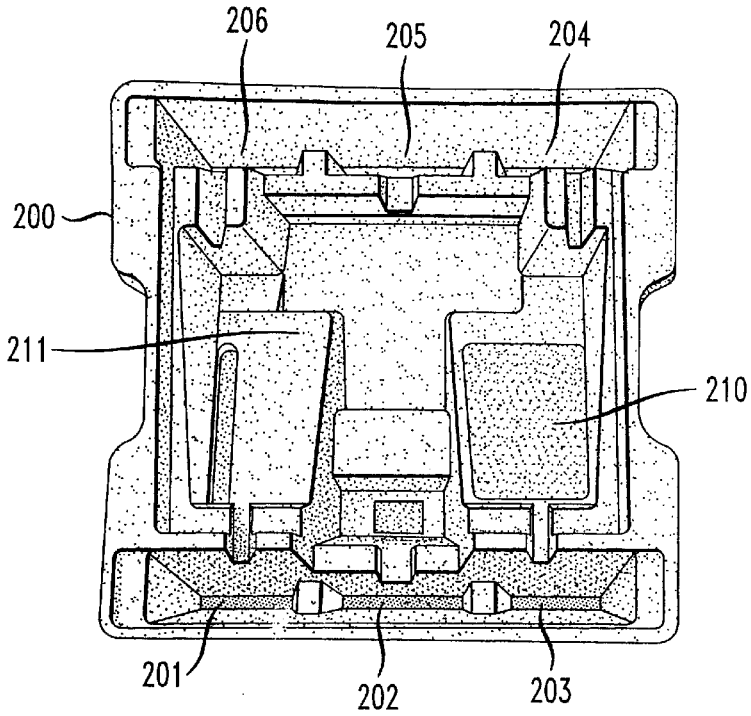
FIGS. 3 and 4 illustrate, respectively, top and bottom views of a typical lower tray that is used in the present multi-function packing insert.
Figure 4:
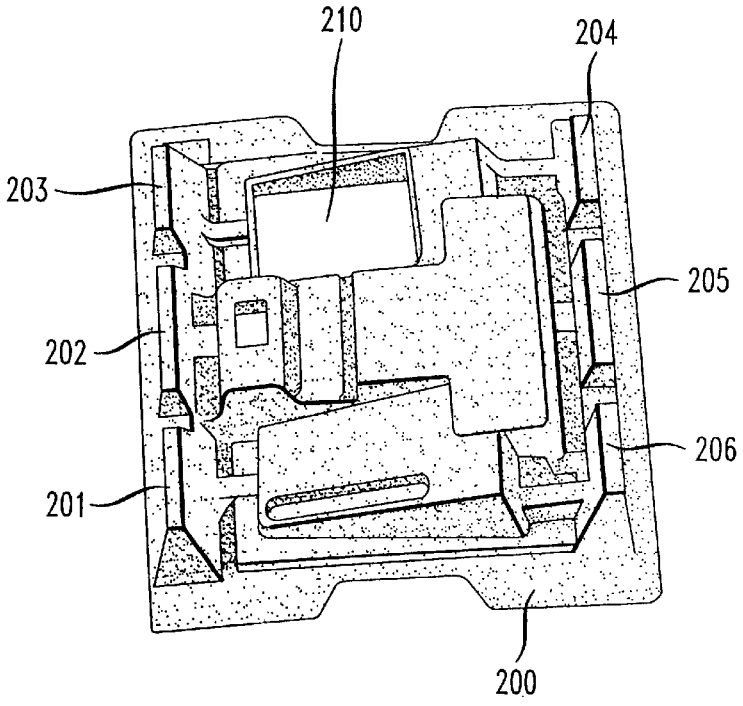
Figure 5:
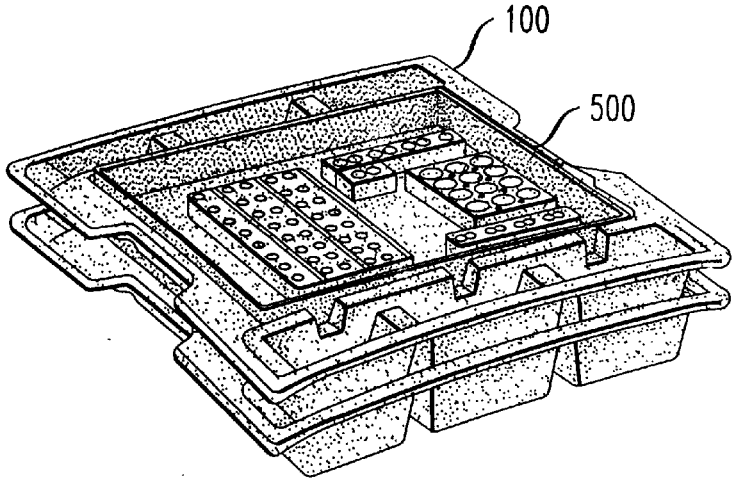
FIGS. 5 and 6 illustrate, respectively, perspective views of a typical upper housing packing insert and a typical lower housing packing insert that are used to ship subassemblies in stacked form from the supplier.
Figure 6:
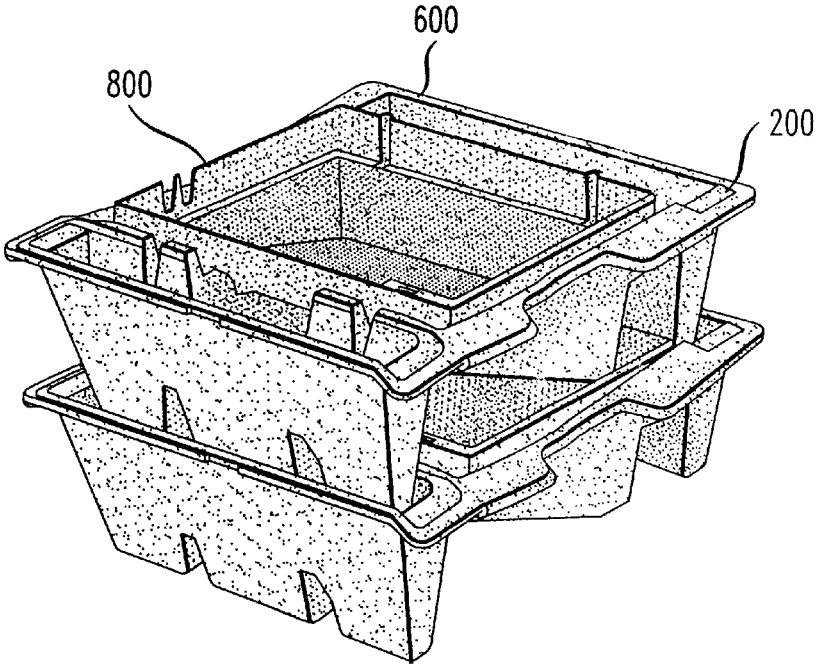

FIGS. 1 and 2 illustrate, respectively, top and bottom views of a typical upper tray that is used in the present multi-function packing insert, while FIGS. 3 and 4 illustrate, respectively, top and bottom views of a typical lower tray that is used in the present multi-function packing insert. FIGS. 5 and 6 illustrate, respectively, perspective views of a typical upper housing packing insert and a typical lower housing packing insert that are used to ship subassemblies in stacked form from the supplier. As an example, a first packing insert 100 shown in FIGS. 1, 2, 5 is used to house the upper half 500 of the product housing and includes a plurality of stabilizing pedestals 101–106 to provide positive location and stacking during shipment of the upper half 500 of the product housing from the supplier. The second packing insert 200 is illustrated in FIGS. 3, 4, 6 and is used to house the lower half 600 of the product housing from the supplier. Once the two packing inserts 100, 200 are located in-house at the manufacturer, the two packing inserts are used as assembly fixtures and/or trays to convey the product through the assembly process ready for boxing at the final product shipping.

As an example, FIGS. 5 and 6 show the use of the first 100 and second 200 packing inserts being used to house two subassemblies comprising an upper half 500 of the product housing and a lower half 600 of the product housing. The product housing comprises the exterior shell of a telephone station set. These subassemblies were formerly shipped to the manufacturer by the supplier(s) packaged in an electrostatic discharge protective bag to prevent static buildup on the components contained therein. An abrasion protective strip is also placed on the display window of the product housing to prevent damage to the display window that can be caused by the formerly used packaging rubbing on the display window during shipment from the supplier. Thus, the workers at the manufacturing facility were required to remove the upper half 500 of the product housing and the lower half 600 of the product housing from their shipping cartons and associated packaging, remove the electrostatic protection bag, remove the abrasion protective strip, dispose of or recycle the shipping cartons, associated packaging, electrostatic protection bag, and abrasion protective strip. The upper half 500 of the product housing and the lower half 600 of the product housing are then placed on a conveyor system to enable the workers to assemble and test the telephone station set that is assembled and enclosed within the packing inserts. Once the assembly and testing processes are completed, the workers must then package the telephone station set for shipping. This formerly entailed maintaining a large stack of Expanded Polystyrene (EPS) inserts which were used to enclose the assembled telephone station set prior to being placed in a shipping carton.

Figure 7:
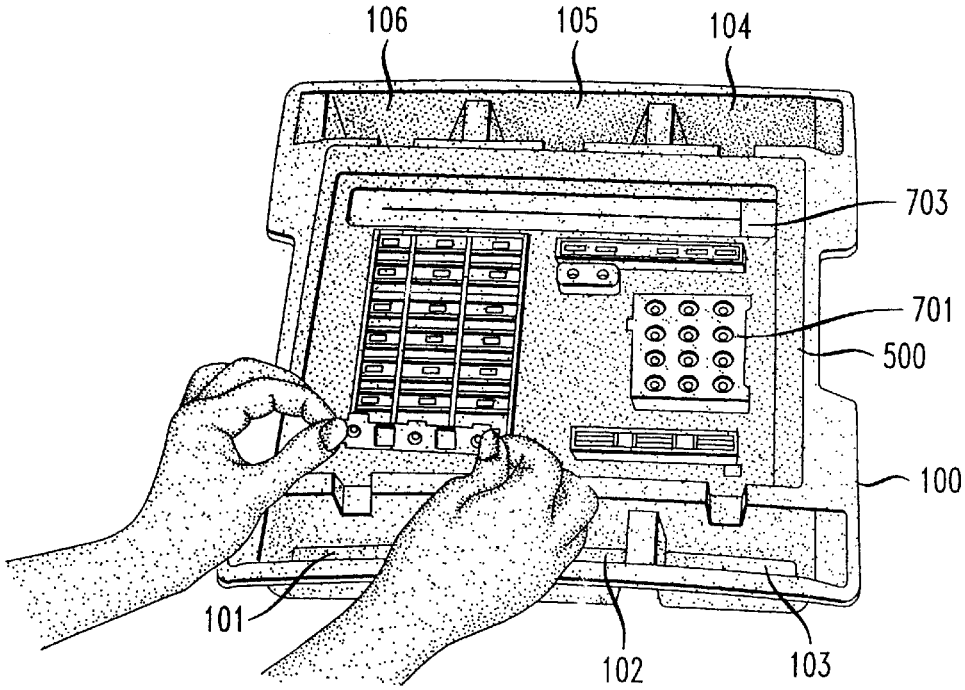
FIG. 7 illustrates a perspective view of a worker using a typical lower housing packing insert, with a subassembly located therein, as an assembly fixture during the manufacturing process.
Figure 8:
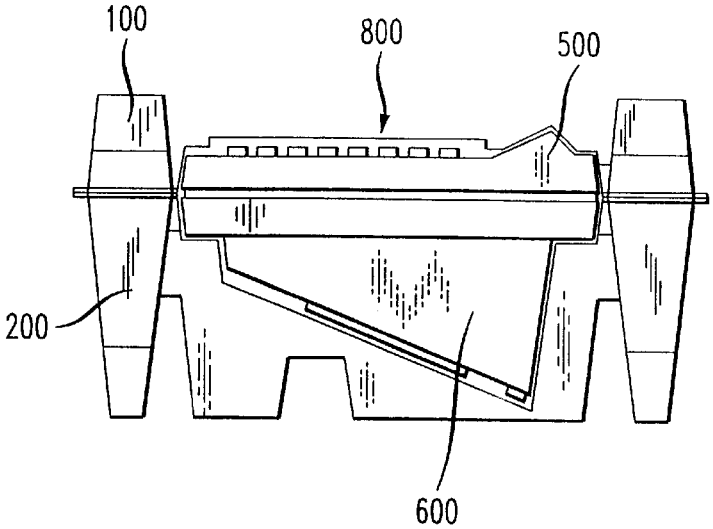
FIG. 8 illustrates a side cross-section view of a typical product ready for boxing using the present multi-function packing insert.

The present first 100 and second 200 packing inserts significantly reduce the complexity and cost of the above-noted manufacturing process by eliminating the need for the formerly used large stack of Expanded Polystyrene (EPS) inserts and the need to dispose of or recycle the formertly used shipping cartons, associated packaging, electrostatic protection bag, and abrasion protective strip. This is accomplished by fabricating the present first 100 and second 200 packing inserts from recycled paper to create static free packing inserts to thereby make these packing inserts received from the vendor 100% recyclable and 100% biodegradable. This reduces the cost of shipping by eliminating the need to dispose of the shipping cartons, associated packing, electrostatic discharge bag and abrasion protection strip received from the vendor. As shown in FIGS. 4 and 6, the first 100 and second 200 packing inserts, with their respective included upper half 500 of the product housing and lower half 600 of the product housing are stackable to occupy less space than individually packed ones of the previous method of packing the upper half 500 of the product housing and lower half 600 of the product housing. FIG. 7 illustrates how the upper half 500 of the product housing, as located in its first 100 packing insert as received from the supplier, can be used on the assembly line by a worker as an assembly tray to hold the upper half 500 of the product housing as various other components, such as 701–703 are added to the upper half 500 of the product housing during manufacture. The upper half 500 of the product housing and lower half 600 of the product housing are transported along the assembly line in their respective first 100 and second 200 packing inserts to enable the workers to assemble and test the telephone station set that is enclosed in the product housing that comprises the upper half 500 of the product housing and the lower half 600 of the product housing. The first 100 and second 200 packing inserts include a plurality of stabilizing pedestals 101–106, 201–206 to provide positive location during piece part shipment, and these stabilizing pedestals also facilitate movement of the first 100 and second 200 packing inserts along the conveyor and/or roller guide sections of the assembly line. The assembly line workers can optionally use the packing inserts 100, 200 and the stabilizing pedestals 101–106, 201–206 to store components during the product assembly process so that the final assembled product 800 arrives in the final packaging area already enclosed in the packing inserts 100, 200 and is ready for boxing. The final telephone station set product 800, comprising the assembled upper half 500 and lower half 600 of the product housing, enclosed by packing inserts 100 and 200, is illustrated in side cross section view in FIG. 8.

The second 200 packing insert is shown as optionally including an opening 210 in the bottom 211 thereof, which opening 210 exposes a predetermined location of the lower half 600 of the product housing to enable the workers to identify the specific model of the lower half 600 of the product housing that is stacked in the second 200 packing insert. For example, the lower half 600 of the product housing can have labeling attached thereto that includes a bar code that can then be scanned through the opening 210 without the need for the lower half 600 of the product housing being removed from the second 200 packing insert. Other openings in the first 100 and second 200 packing inserts can also be included to facilitate testing of the telephone station set 800 or the like.

While a specific embodiment of the multi-function packing insert has been disclosed herein, it is expected that a multitude of variations of this design can be created by those skilled in the art, since this particular embodiment contains details that are specific to the telephone station set that is enclosed therein. Obviously, other products necessitate variations in the implementation of the multi-function packing insert to accommodate the product specific dimensions and shape. The present embodiment is not intended to limit the scope of applicability of the multi-function packing insert concept as defined in the appended claims but is merely used to illustrate the basic multi-function packing insert concept.

SUMMARY

This multi-function packing insert is designed to enable the manufacturer to reuse the packing inserts that are received from the component and subassembly vendor(s) thereby providing a significant cost savings to the manufacturer by reducing the cost of packing materials to ship the completed product to the customer, since the packing materials received from the vendor(s) are used for this purpose. This provides a significant savings in packing materials and reduces material handling and floor space requirements throughout the manufacturing process. Reuse of the vendor packaging also reduces the amount of overall contribution to the waste system.

What is claimed:

1. A method for utilizing a packing insert for use in shipping from a vendor to a manufacturer, component parts used to manufacture a final assembled product as well as shipping said final assembled product from said manufacturer to a customer, the method comprising:

packing said component parts in said packing insert;

shipping said packing insert containing said component parts from said vendor to said manufacturer;

assembling said component parts into said final assembled product; and shipping said packing insert containing said final assembled product from said manufacturer to said customer.

2. The method of claim 1 wherein said step of packing said component parts further comprises:

placing at least one of said component parts in a first part of said packing insert;

placing at least one of said component parts in a second part of said packing insert; and stacking said first part of said packing insert on said second part of said packing insert.

3. The method of claim 1 wherein said step of assembling said component parts further comprises:

placing said packing insert containing said component parts in an assembly line;

moving said packing insert along said assembly line; and assembling a portion of said component parts as said packing insert is moved along said assembly line until a final assembled product is produced.

4. The method of claim 1 wherein said assembling step further comprises the step of:

assembling at least a portion of said component parts into said final assembled product in said packing insert.

* * * * *